United States Patent [19]

Contri

[11] Patent Number: 4,661,685

[45] Date of Patent: Apr. 28, 1987

[54] ELECTRONIC PRESSING IRON

[75] Inventor: Robert F. Contri, Westmont, Ill.

[73] Assignee: John Zink Company, Tulsa, Okla.

[21] Appl. No.: 773,383

[22] Filed: Sep. 6, 1985

[51] Int. Cl.[4] ..... D06F 75/26

[52] U.S. Cl. ..... 219/250

[58] Field of Search ..... 219/245, 250–257; 38/82, 88, 90–92

[56] References Cited

U.S. PATENT DOCUMENTS

| | | | |
|---|---|---|---|
| 2,833,903 | 5/1958 | Waddell | 219/251 X |
| 4,322,900 | 4/1982 | Hacker et al. | 219/252 X |
| 4,520,257 | 5/1985 | Schwob et al. | 219/250 |
| 4,523,079 | 6/1985 | Albinger | 219/251 |

FOREIGN PATENT DOCUMENTS

| | | | |
|---|---|---|---|
| WO82/03520 | 10/1982 | PCT Int'l Appl. | 219/251 |

*Primary Examiner*—Donald A. Griffin

*Attorney, Agent, or Firm*—Neil M. Rose

[57] ABSTRACT

An electronic pressing iron having a soleplate and a housing connected to the soleplate is disclosed herein. An electric resistance heating element is mounted in the soleplate for receipt of an alternating current from a suitable source. A temperature control thermostat is connected in series with the electric heating element and is mounted in good heat conduction relationship with the soleplate to control the temperature thereof. A motion and attitude sensing switch is mounted in a handle of the housing and provides a motion signal to a programmable timer also mounted in the handle. A thermal relay mounted in the handle is connected to the programmable timer to receive a time out signal therefrom. When the electronic pressing iron is switched on and is stationary with its soleplate oriented horizontally, for a period of thirty seconds, the programmable timer signals the thermal relay which interrupts the electric current flowing through the heating element. When the electronic pressing iron is resting on its heel rest and is not moved for a period of sixteen minutes, the programmable timer also signals the thermal relay to interrupt electric current flowing through the electric heating element.

13 Claims, 5 Drawing Figures

ELECTRONIC PRESSING IRON

BACKGROUND OF THE INVENTION

One of the primary safety problems facing persons operating electric pressing irons involves the fact that the iron, if left unattended can constitute a fire or safety hazard to children. In the past a number of schemes have been developed to interrupt power to an electric heating element of a pressing iron in the event that the iron is not being used.

Recently an electronic pressing iron was developed which has a motion and attitude sensing circuit which terminates a flow of electric power to the heating element when the pressing iron is positioned with its soleplate horizontal and not moving for a period of thirty seconds. That electronic pressing iron is disclosed in a U.S. patent application, Ser. No. 605,442, filed Apr. 27, 1984, entitled ELECTRONIC PRESSING IRON and assigned to the same assignee as this application.

That electronic pressing iron also has the ability to interrupt electric power to the electric heating element when the pressing iron is positioned with its soleplate in a substantially vertical plane or is resting on its heel rest for a period of ten minutes.

Thus, it may be appreciated that when the pressing iron has its soleplate in the lowered or horizontal position electric power is quickly interrupted if the pressing iron is not being moved in order to prevent damage to fabrics upon which the iron may be resting and to avoid the likelihood of fire.

Similarly, when the pressing iron was positioned in the soleplate raised position, electric power was interrupted to the heating element after a ten minute period in that position to allow the soleplate to cool down.

One of the drawbacks of that electronic pressing iron lies in the fact that the circuit required to perform the motion and attitude sensing functions is relatively bulky, portions of it being located in the handle of the pressing iron, ard other portions being located in a heel rest cavity within the pressing iron. That construction requires numerous electrical leads which connect the circuits in the handle to the circuits in the heel rest to be threaded through the back of the pressing iron, leading to significantly increased production costs over those found in a conventional pressing iron. In addition, the switching device which controls the electric power flowing to the heating element comprises a direct current relay which is relatively expensive and bulky. Additional power handling circuits are required to convert the alternating line current which the pressing iron receives to direct current so that the direct current relay may be employed in the circuit.

Thus there is a need for a low cost compact circuit which may be substantially enclosed within the handle portion of the pressing iron away from the heel rest portion where the circuit may be exposed to moisture. What is also needed is an electronic pressing iron which can interrupt power to its heating element after a relatively brief period in which the soleplate is stationary and horizontal and which can interrupt power to its electric heating element after a longer period when the soleplate is in a substantially vertical plane.

SUMMARY OF THE INVENTION

An electric pressing iron is disclosed herein which includes a soleplate having an electric resistance heating element mounted in good heat conducting relationship therewith. The electric heating element is adapted to receive alternating current from a suitable external source. A plastic shell housing is connected to the soleplate and includes a motion and attitude sensing circuit having a mercury switch operatively associated therewith. The motion and attitude sensing circuit also includes a programmable timer driven from a constant period clock circuit. The programmable timer provides a first relatively short period timing function which is reset from time to time as the pressing iron is moved with the soleplate in the horizontal or down position. The pressing iron also includes a long period timing function which is periodically reset except when the iron is stationary with the soleplate in the raised or vertical position.

In the instant invention when the electronic pressing iron is resting on its soleplate and not moving for thirty seconds, the programmable timer generates an output signal which is fed to a silicon controlled rectifier which controls a thermal relay. The thermal relay in a preferred form of the invention comprises a ceramic positive temperature coefficient (PTC) heater connected in good electrical and heat conducting relationship with a snap action thermostat. The snap action thermostat is connected in series with the source of alternating line current and the electric resistance heating element in the soleplate. When the PTC heater is energized by the programmable timer at the end of the thirty second interval, the snap action thermostat opens, interrupting the flow of electric power to the electric heating element. Likewise, when the electronic pressing iron is in the heel rest position, after a period of sixteen minutes, the programmable timer produces an output signal which energizes the PTC heater causing the thermostat of the thermal relay to open and to interrupt electric power to the electric heating element.

A neon indicating lamp is connected in series with the PTC heater of the thermal relay. The neon indicating lamp remains off when the electronic pressing iron is switched off. The lamp is on and illuminated steadily when the electronic pressing iron is on and flashes when the programmable timer has timed out either in the soleplate down position or in the heel rest position to provide an output indication to the user that the motion and attitude sensing circuit has disabled the electric heating element.

An object of the present invention is to provide an electronic pressing iron having a compact and reliable motion and attitude sensing circuit for automatically interrupting power to an electric heating element in a soleplate when the electronic pressing iron is not being used.

Another object of the instant invention is to provide an electronic pressing iron having a compact thermal relay control which occupies very little space but is able to switch relatively large currents flowing through the electric heating element in the soleplate.

A still further object of the present invention is to provide an electronic pressing iron having a highly accurate, programmable timer which is unaffected by manufacturing variations.

A still further object of the instant invention is to provide an electronic pressing iron having a digital timer which is unaffected by the presence of moisture in the vicinity of the motion and attitude sensing circuit in order to provide a highly accurate timing function.

Another object of the present invention is to provide an electronic pressing iron wherein the user is provided an output indication as to whether the iron is off, on, or the heating element is disabled.

Further objects and advantages of the instant invention will become apparent to one skilled in the art upon perusal of the following specification and claims in light of the accompanying drawings.

DESCRIPTION OF THE PREFERRED EMBODIMENT

Figure 1:
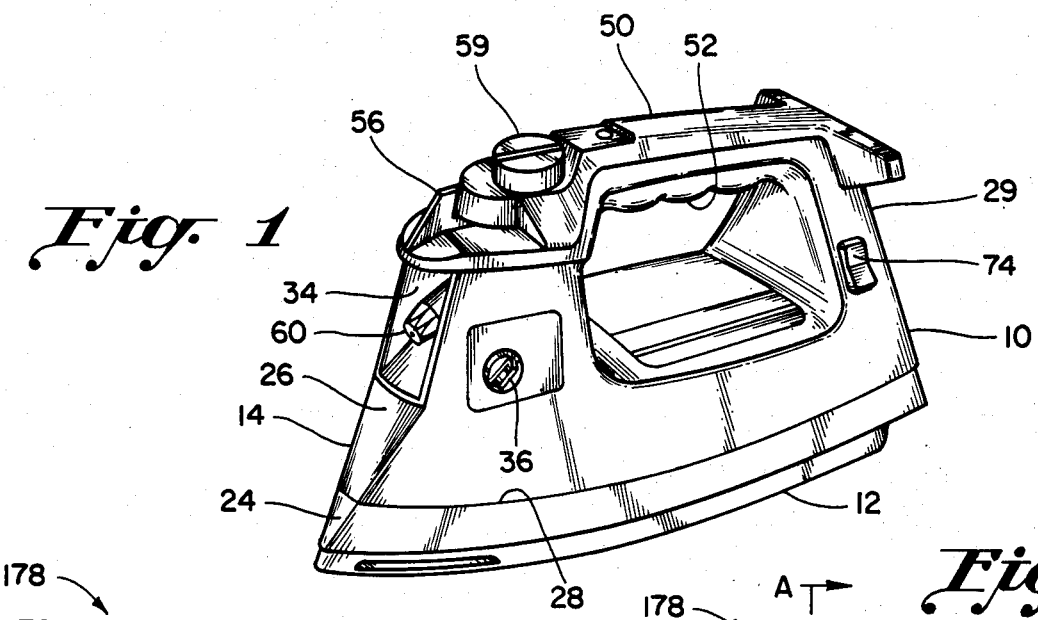
FIG. 1 is a perspective view of an electronic pressing iron comprising our invention.

Referring now to FIG. 1 of the drawings, there is shown an electronic pressing iron 10 embodying the instant invention and having a soleplate 12 and a plastic housing 14 connected thereto. The soleplate 12 has an electric resistance heating element 16 (shown only schematically in FIG. 4) mounted in good heat conducting relationship therewith. A conventional soleplate temperature control thermostat 18 of a type well known to those skilled in the art and employed in electric pressing irons is connected to the soleplate 12 by a threaded fastener 20 which engages a thermally conducting mounting block 22.

The plastic housing 14 includes a phenolic lower housing 24 and a thermoplastic polyester upper housing 26. The phenolic lower housing 24 and the thermoplastic polyester upper housing 26 are sealed together with a room temperature vulcanizing compound at a joint 28. The plastic housing 14 also has a heel rest portion 29 located at the rear thereof.

The soleplate 12 has a bottom face or pressing surface 30 adapted to be placed in contact with a suitable fabric to be ironed.

The lower phenolic housing 24 and the upper thermoplastic polyester housing 26 together define a water tank 32 which may be filled with water through a funnel-like structure 34 at the front of the electronic pressing iron 10 as is conventional. Water contained in the tank 32 may be delivered to the soleplate 12 where it is converted to steam in a well known manner. The water delivery is controlled by a steam setting control 36 which is mechanically connected to a steam valve structure 38 in a well known fashion.

Figure 3:
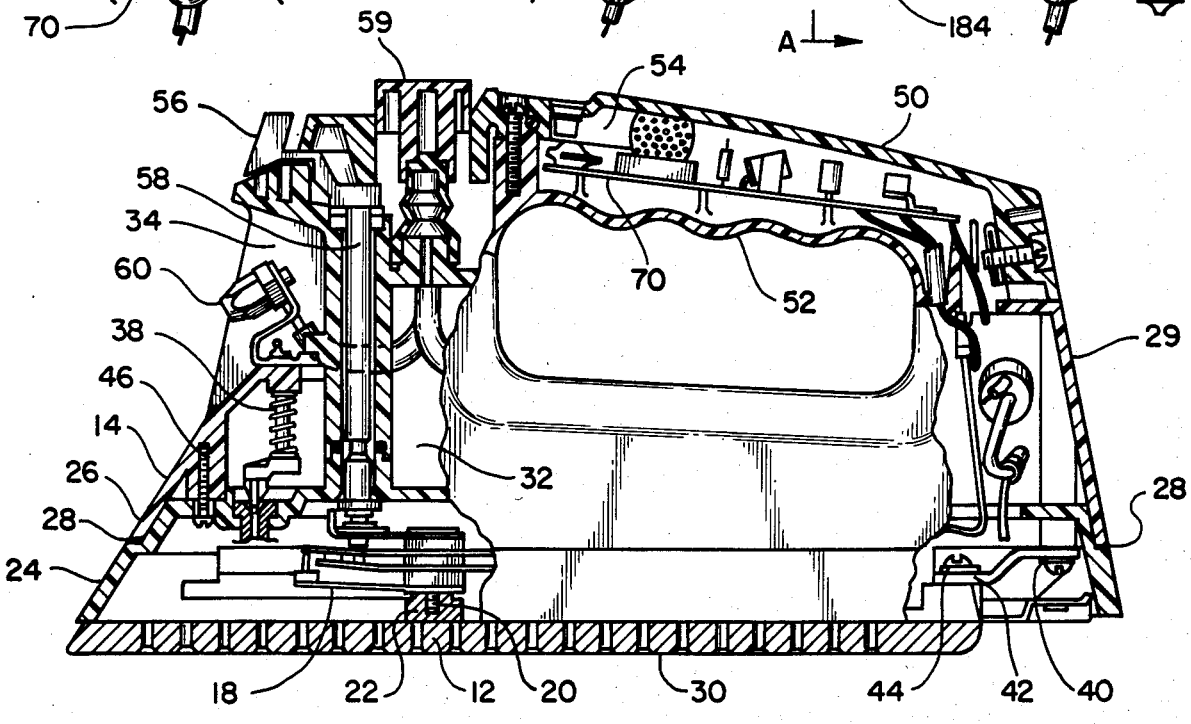
FIG. 3 is a side elevational view having portions broken away to show sectional details of the electronic pressing iron of FIG. 1.

The lower phenolic housing 24 is secured to the soleplate 12 by a plurality of threaded fasteners including a threaded fastener 40 connected to a rear clip 42 which is connected by a threaded fastener 44 to the soleplate 12. The upper thermoplastic polyester housing 26 is secured to the lower phenolic housing 24 by a plurality of threaded fasteners, one of which is shown in FIG. 3 and indicated as fastener 46. The upper thermoplastic housing 26 includes a handle section 50 having a grip portion 52. The handle section 50 and the grip portion 52 define a hollow interior portion 54.

A temperature selector 56 is mounted on an upper part of the upper thermoplastic housing 26 and is connected by a control rod 58 to the thermostat 18 in order to select a temperature setpoint to which the thermostat 18 may control the soleplate in a manner well known to those skilled in the art.

A pair of reciprocating pumps 59, one of which is shown in FIG. 3, is contained in the upper portion of the upper thermoplastic housing 26. The reciprocating pumps 59 are adapted, respectively, to draw water from the water tank 32 and deliver it to a spray head 60 or to the soleplate 12 in order, respectively, to produce a spray of water from the front of the electronic pressing iron 10 for dampening fabrics to be ironed and to produce an extra quantity of steam to be delivered to the fabric through steam vents in the soleplate 12. Both of these functions are performed in a manner well known to those skilled in the art and particularly as disclosed in U.S. Pat. No. 4,398,364 to Augustine, et al. which is also assigned to the assignee of this application.

Figure 4:
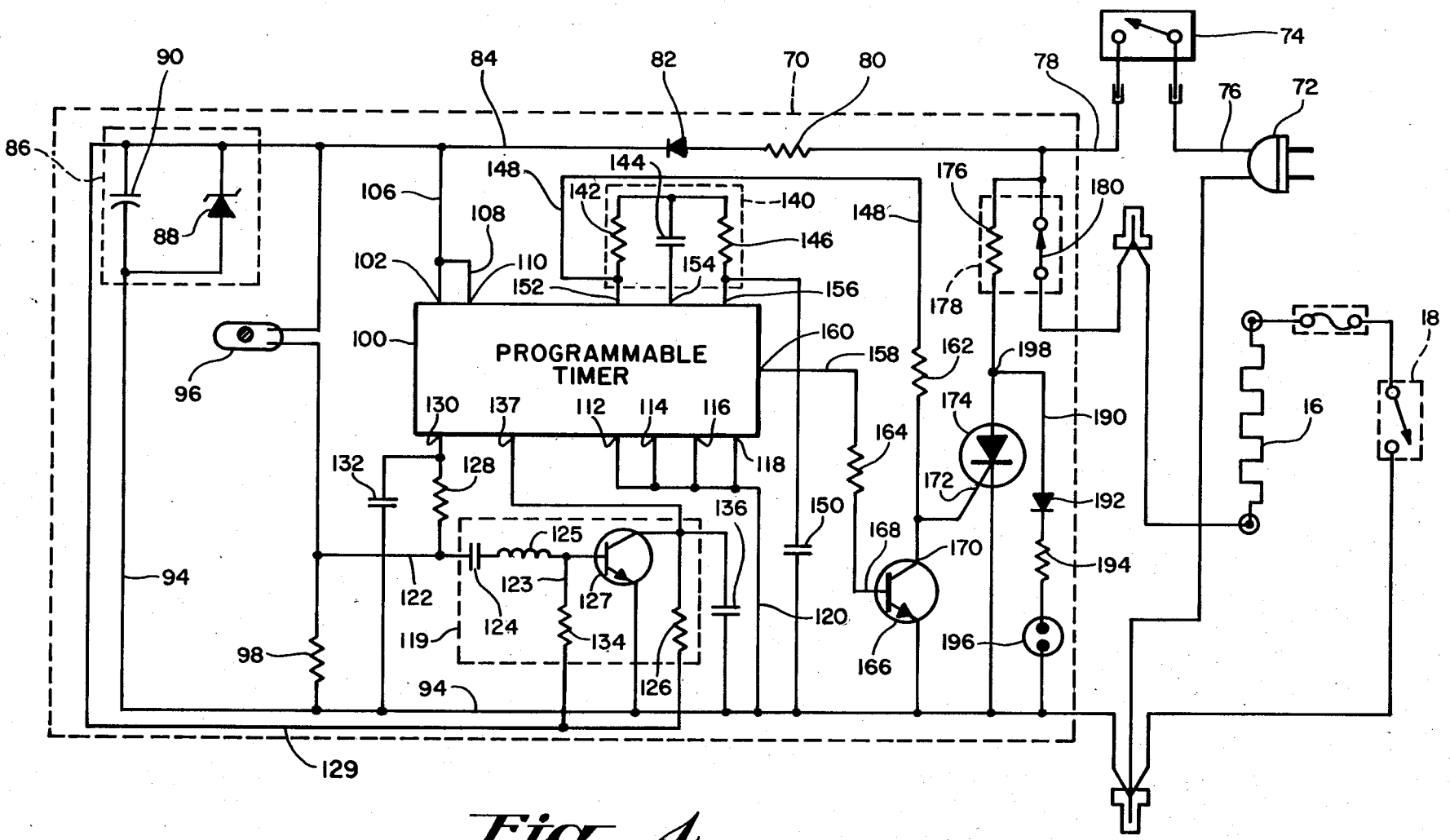
FIG. 4 is a schematic diagram of the electrical circuit of the electronic pressing iron of FIG. 1.

The interior 54 of the handle 50 encloses a printed circuit board 70 having an electronic circuit mounted thereon. Referring now to FIG. 4, a conventional alternating current line connector 72 is shown therein which is connected to a power control switch 74. Switch 74 in this case is a single pole rocker type switch, although other types of switches may be substituted therefor by one skilled in the art. Alternating current, received from a suitable source of alternating current such as a 110 volt AC wall socket, is fed from the connector 72 through a lead 76 to the rocker switch 74. The rocker switch 74 is, in turn, connected to a lead 78 which feeds current through a 22 kilohm resistor 80. The resistor 80 acts as a current limiter to deliver reduced potential AC to a half wave rectifying diode 82 connected in series with it. The diode 82 is, in this embodiment, a 1N4004 diode. The diode 82 is connected to a lead 84 which delivers half wave rectified DC to a combination filter-voltage regulator 86. The filter-voltage regulator 86 includes a zener diode 88, in this embodiment a 1N5242B 12 volt one-half watt zener diode, which is connected in parallel with a 22 microfarad 16 volt electrolytic capacitor 90. The combination of the zener diode 88 the electrolytic capacitor 90 provides a clipped, voltage regulated DC signal having a potential of +12 volts at the lead 84.

A lead 94 is also connected to the filter-voltage regulator 86 opposite the lead 84 and comprises a ground bus for other portions of the circuit.

A mercury switch 96 is connected between the lead 84 and a 47 kilohm resistor 98. Resistor 98 is connected to lead 94. The mercury switch 96, as will be described in more detail hereinafter, senses both the state of motion and the attitude or orientation of the electronic pressing iron 10 and provides an output signal representative thereof to other portions of the circuit.

A programmable timer 100, in this embodiment a Motorola MC14541B programmable timer, is connected at its $V_{DD}$ pin 102 to receive the 12 volt potential from the lead 84 which is delivered to the pin 102 through a lead 106. A parallel lead 108 also delivers the positive 12 volt potential to a $Q/\overline{Q}$ select pin 110. An auto-reset pin 112, a $V_{SS}$ pin 114, a cycle mode pin 116 and a modulo divider B pin 118 are all connected by a lead 120 to the ground bus 94 to maintain the pins 112 through 118 at zero volts. The resistor 98 is connected through a lead 122 to a frequency doubler cicuit 119 including a 0.01 microfarad capacitor 124, which is connected to a 560 microhenry coil 125. The coil 125 is connected by a lead 123 to resistor 134 and is also connected to the base of a transistor 127. A resistor 126 is connected to the collector of transistor 127 and also to the reset pin 137 of the programmable timer. Resistors 126 and 134 are connected to the +12 volt potential at lead 84 by a lead 129. In combination all of these components provide reset pulses to the programmable timer 100, as will be seen hereinafter. A 220 picofarad capacitor 136 is connected between the master reset pin 137 and the ground bus 94. The lead 122 is also connected to a 220 kilohm resistor 128 which is connected to a modulo divider A pin 130. The modulo divider A pin 130 is also connected to the ground lead 94 through a 220 picofarad capacitor 132.

A clock circuit 140 consisting of a 2.2 megohm resistor 142, a 0.047 microfarad capacitor 144 and a 3.9 megohm resistor 146 is connected to the programmable timer 100 and generates an approximately 4 Hz oscillator signal which is supplied to a lead 148 connected to the resistor 142. A 220 picofarad noise bypass capacitor 150 is connected between the resistor 146 and the ground bus 94. The resistor 142 is also connected to an $R_{tc}$ pin 152 of the programmable timer 100. The capacitor 144 is connected to a $C_{tc}$ pin 154 of the programmable timer 100. The resistor 146 and capacitor 150 are connected to an $R_s$ pin 156 of the programmable timer 100. An output lead 158 is connected to a Q pin 160 of the programmable timer 100.

In operation, DC voltage to operate the programmable timer 100 is supplied to the $V_{DD}$ pin 102 and $V_{SS}$ pin 114 of the programmable timer 100. The modulo divider B pin 118 is latched low, as is the cycle mode pin 116 and the auto reset pin 112. The $Q/\overline{Q}$ select pin 110 is latched high to select Q output pin 160 as being set high after reset. Once the programmable timer 100 is energized, the timing network 140 generates the 4 Hz clock signal, which is fed to the programmable timer 100 and is also fed through the lead 148 to a 47 kilohm resistor 162.

When the electronic pressing iron 10 is positioned on its heel rest, the mercury switch 96 remains open so that the resistor 98 and the lead 122 are held substantially at ground potential. Therefore, the pin 130 is also at ground potential selecting a high modulus which will cause the programmable timer 100 only to generate an output signal indicative of a time out event when the mercury switch 96 is not closed for sixteen minutes. At the end of the sixteen minutes, the Q output at the pin 160 would switch low, pulling low a resistor 164 which is connected to pin 160 by the lead 158. When the resistor 164 has a low voltage, a transistor 166, which is connected at a base 168 to resistor 164, switches nonconducting. When the transistor 166 switches nonconducting, its collector 170, which is connected to a gate 172 of a silicon controlled rectifier 174, would be allowed to float at a potential of the $R_{tc}$ pin 152 so that the 4 Hz clock pulses would switch the SCR 174 on four times a second, allowing current to flow through the SCR 174 and through a positive temperature coefficient heater 176 of a thermal relay 178. This would cause a bimetallic thermostat 180 of the thermal relay 178 to open, interrupting electric power flowing through the thermal relay and the electric heating element 16. In the preferred form of the invention, the thermal relay is of the snap acting type.

In the event that the electronic pressing iron 10 is in the soleplate down position and is not moving, the mercury switch 96 remains closed, causing the pin 130 to reach approximately 12 volts which sets the modulo divider pins so that the programmable timer 100 times out more rapidly. When the mercury switch 96 remains closed continuously for 30 seconds, the Q output pin 160 would drop low, switching the SCR 174 on, and allowing alternating current to flow through the PTC heater 176 to open the thermostat 180.

In the event that the electronic pressing iron 10 is moving, whether the soleplate 12 is down or up, the mercury switch 96 will be opening and closing as mercury within the switch is accelerated by the changing motion of the electronic pressing iron 10. The pulses from the opening and closing of the mercury switch 96 are applied to the frequency doubling circuit 119 consisting of capacitor 124, inductor 125, resistors 134 and 126, and transistor 127. Resistor 126 applies the +12 volt potential to reset pin 137, causing the programmable timer 100 to reset and cease timing. The transistor 127 is biased into its conducting state by resistor 134, causing it to shunt the potential applied to reset pin 137, thus allowing programmable timer 100 to function in its normal timing mode.

When the mercury switch 96 is initially closed, current will attempt to flow through capacitor 124 and inductor 125. The inductor 125 will momentarily oppose this current, reverse biasing transistor 127 off and, therefore allowing the reset pin 137 to receive the +12 volt potential. When the mercury switch 96 is opened, capacitor 124 will discharge through resistor 98, again momentarily reverse biasing transistor 127 off and enabling the +12 volt potential to appear on reset pin 137. Thus it can be realized that each time the electronic pressing iron 10 is moved, causing mercury switch 96 to either open or close, the programmable timer 100 is reset, thereby preventing it from timing out and disabling the iron in the manner to be described hereinafter.

Figure 2A:
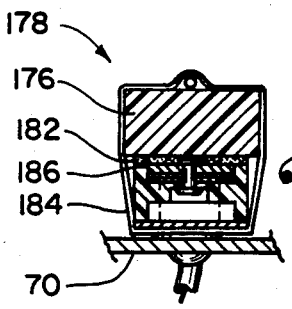
FIG. 2A is a sectional view taken on line A—A of FIG. 2.
Figure 2:
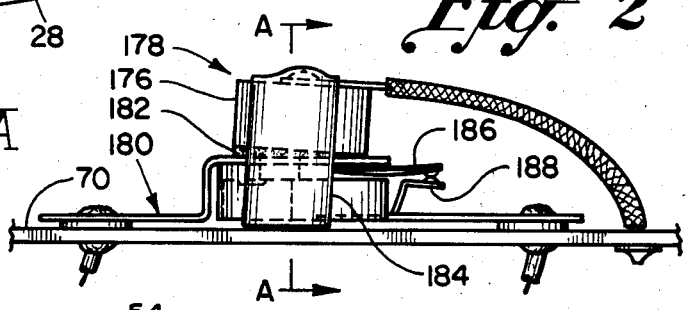
FIG. 2 is a side elevational view of a thermal relay contained within the electronic pressing iron of FIG. 1 for controlling a flow of electric current through an electric heating element in a soleplate of the electronic pressing iron.

Thus, the combination of the mercury switch 96, together with the programmable timer 100 as configured, provides a motion and attitude sensing apparatus which is capable of interrupting current through the electrical heating element 16. One of the particular advantages of the instant circuit lies in the use of the thermal relay 178 wherein the PTC heater 176 is connected to the snap acting thermostat 180, as may best be seen in FIGS. 2 and 2A. The PTC heater 176 is connected to the snap acting thermostat 180 by an epoxy bonding compound 182 which is both electrically conductive and heat conductive or alternatively by a tin-lead solder. A shrink fit plastic sleeve 184 surrounds the PTC heater 176 and the snap acting thermostat 180 to secure better the PTC heater 176 to the snap acting thermostat 180.

It may be appreciated that when the PTC heater 176 is energized, heat flows to a bimetal moving member 186 of the snap acting thermostat 180 which is normally in electrically conductive contact with a fixed electrical contact 188. As the bimetal member 186 heats up, it moves away from the contact member 188 and travels into an off position whereby the alternating current flowing through the thermal relay 178 is interrupted. It may also be appreciated that the thermal relay 178 can handle large amounts of current while occupying a relatively small amount of space. Furthermore, no special current conditioning measures are necessary to be taken for the PTC heater as might be needed for a conventional solenoid of a direct current relay.

An indicating leg 190 is connected in parallel with the silicon controlled rectifier 174. When the rocker switch 74 is open, no current flows through the indicating leg 190, which consists of a diode 192, an 18 kilohm resistor 194 and a neon lamp 196. When the rocker switch 74 is closed and current flows through the circuit, as long as the silicon controlled rectifier 174 remains nonconducting, maintaining the electronic heating element 16 in an enabled mode, a junction 198 of the silicon controlled rectifier anode and the lead 190 remains at a relatively high voltage providing sufficient potential drop across the neon lamp 196 to illuminate it continuously. If the silicon controlled rectifier 174 is switched conducting, the potential at the junction 198 drops below the magnitude at which the potential drop across the neon lamp 196 can illuminate it. It may be appreciated that the relatively large resistance 194 prevents significant current flow through the PTC heater when the silicon controlled rectifier 174 is off, thus avoiding substantial heating of the PTC heater and false opening of the thermal relay 178.

Thus, it may be appreciated that all of the circuit components including the motion and attitude sensing switch 96, the programmable timer 100 and the thermal relay 178 are mounted compactly inside the handle 50. In addition, the thermal relay 178 provides a compact switching element which can be used to control the flow of electric current through the electric heating element 16.

In the disclosed embodiment, the electronic circuitry remains energized after the thermal relay 178 has been actuated to disable the power to the heating element 16. As an alternative embodiment, the electronic circuit could be connected in parallel with the heating element 16 and the thermostat 18 and in series with the switch 180 so that the electronic circuit would be disabled along with the heating element 16 when the relay 178 opened. In this embodiment, a manual reset would be required for the thermal relay 178 so that the electronic circuit could be powered up along with the heater 16 after conditions had caused the relay 178 to open.

While there has been shown and described several embodiments of the present invention, it will be apparent to those skilled in the art that various changes and modifications may be made without departing from the invention in its broadest aspects, and it is, therefore, contemplated in the appended claims to cover all such changes and modifications as fall within the true spirit and scope of the present invention.

What is claimed as new and desired to be secured by Letters Patent of the United States is:

1. A safety circuit for disabling a heating element of a pressing iron, comprising: a motion sensor connected to a pressing iron and producing a motion sensor signal in response to a state of motion of said pressing iron; a timer connected to said motion sensor and receiving said motion sensor signal therefrom, said timer being reinitialized when said motion sensor signal indicates said pressing iron is moving, said timer generating a time-out signal after a predetermined period from last receipt of said motion sensor signal indicating said pressing iron is in motion; and a thermal relay connected to said timer and being responsive to said time-out signal therefrom, said thermal relay including a heat operated switch and an electric heater positioned to actuate said switch, said electric heater being connected to a source of electric current and to said timer, said heat operated switch being connected in series with an electric heating element, said thermal relay disabling a flow of an electric current through said electric heating element upon receipt of said time-out signal by said electric heater.

2. A electric pressing iron comprising: a soleplate; and electric heating element mounted in heat conducting relationship with said soleplate; a thermostatic switch mounted on said soleplate to control the temperature thereof and connected on series circuit with said electric heating element; a housing connected to said soleplate; means for sensing a mechanical condition connected to said housing; a thermal relay including a heat operated bimetallic switch and an electric heater mounted on said switch in position to actuate said switch when energized, said electric heater being connected to said means for sensing said mechanical condition, said heat operated bimetallic switch being connected in series with said electric heating element, said thermal relay acting in response to a signal from said means for sensing said mechanical condition to interrupt an electric current flowing through said electric heating element and said thermostatic switch.

3. An electric pressing iron as defined in claim 2 wherein said means for sensing said mechanical condition is a motion and attitude sensor adapted to supply a signal to said thermal relay when said electric pressing iron is experiencing a particular type of motion.

4. An electric pressing iron as defined in claim 3 wherein said motion and attitude sensor and said thermal relay is located in a handle portion of said housing.

5. An electric pressing iron comprising: a soleplate; an electric heating element mounted in heat conducting relationship with said soleplate; a housing connected to said soleplate; means for sensing a mechanical condition connected to said housing; a thermal relay connected to said means for sensing said mechanical condition and to said electric heating element, said thermal relay acting in response to a signal from said means for sensing said mechanical condition to interrupt an electric current flowing through said electric heating element, said thermal relay including a positive temperature coefficient heater connected to said means for sensing said mechanical condition and being adapted to generate heat in response to said signal from said means for sensing said mechanical condition.

6. An electric pressing iron as defined in claim 5 wherein said thermal relay includes a bimetal thermostat connected in series with said electric heating element an in good heat conduction relationship with said positive temperature coefficient heater in order to control said electric current flowing through said electric heating element in response to said signal from said means for sensing said mechanical condition.

7. An electric pressing iron as defined in claim 6 wherein a metal doped epoxy affixes said positive temperature coefficient heater to said thermostat in good electrical and heat conducting relationship.

8. An electric pressing iron as defined in claim 6 wherein a tin-lead solder affixes said positive temperature coefficient heater to said thermostat in good electrical and heat conducting relationship.

9. In an electronic pressing iron having a soleplate for pressing a fabric, an electric heating element for supplying heat to said soleplate and being mounted in contact thereon, a thermostatic switch mounted on said soleplate to control the temperature thereof and connected in series circuit with said electric heating element, and a housing connected to said soleplate, an improvement comprising: means for sensing an attitude and a state of motion of said electronic pressing iron and producing a motion and attitude signal representative thereof; means for generating a constant frequency timing signal; means for counting a number of cycles of said constant frequency timing signal to determine a time interval following receipt of said motion and attitude signal; means for storing a count representative of a length of said time interval; means for generating a time-out signal when said means for storing a count reaches a preselected count; and a thermal relay connected to said means for generating said time-out signal, said thermal relay including a heat operated switch and an electric heater positioned to actuate said switch, said heat operated switch being connected in series circuit with said electric heating element and said thermostatic switch, said electric heater being connected to means for generating a time-out signal whereby said thermal relay changes state in response to said time-out signal, said thermal relay interrupting a flow of electric current through said electric heating element when said thermal relay changes state.

10. The combination of claim 9 wherein said electric heater for said thermal relay is controlled by a silicon controlled rectifier connected in series therewith, said series connected electric heater and silicon controlled rectifier being connected in parallel with said heating element, said means for generating a time-out signal being electrically connected to switch said silicon controlled rectifier to a conducting mode upon generation of said time-out signal.

11. The combination of claim 10 including a neon lamp and current limiting resistor connected across said silicon controlled rectifier to indicate when said silicon controlled rectifier is conducting, said time-out signal being a cyclical signal which switches said silicon controlled rectifier conducting and nonconducting to flash said neon lamp while supplying sufficient heat to said thermal relay to maintain it in a nonconducting state.

12. An electronic pressing iron comprising; a soleplate; an electric heating element mounted in good heat conducting relationship with said soleplate, a temperature control thermostat mounted in good heat conducting relationship with said soleplate and electrically connected to said electric heating element to control a flow of electric current therethrough in response to a sensed temperature of said soleplate; a housing connected to said soleplate; means connected to said housing for sensing a mechanical condition; and a thermal relay connected to said means for sensing said mechanical condition and to said electric heating element, said thermal relay including a heat operated switch and an electric heater positioned to actuate said switch, said electric heater connected to actuate said switch in response to a signal from said means for sensing said mechanical condition to interrupt said electric current flowing through said electric heating element.

13. An electric pressing iron comprising: a soleplate; an electric heating element mounted in heat conducting relationship with said soleplate; a temperature control thermostat mounted in good heat conducting relationship with said soleplate and electrically connected to said electric heating element to control a flow of electric current therethrough in response to a sensed temperature of said soleplate; a housing connected to said soleplate and defining a circuit chamber; means mounted within said circuit chamber for sensing a mechanical condition; timing means mounted within said circuit chamber and being connected for response to said means for sensing said mechanical condition; and a thermal relay mounted within said circuit chamber and including a heat operated switch and an electric heater positioned to actuate said switch, said electric heater being electrically connected to said timing means, said heat operated switch being electrically connected in series with said electric heating element and said control thermostat to control a flow of electric current therethrough; said thermal relay acting in response to a signal from said means for sensing said mechanical condition to interrupt said electric current flowing through said electric heating element.

* * * * *